United States Patent [19]

Sharma

[11] Patent Number: 4,761,625

[45] Date of Patent: Aug. 2, 1988

[54] TUNABLE WAVEGUIDE BANDPASS FILTER

[75] Inventor: Arvind K. Sharma, Mercer County, N.J.

[73] Assignee: RCA Corporation, Princeton, N.J.

[21] Appl. No.: 876,487

[22] Filed: Jun. 20, 1986

[51] Int. Cl.[4] ..... H01P 1/207; H01P 1/208; H01P 1/16; H01P 7/00

[52] U.S. Cl. ..... 333/209; 333/33; 333/212; 333/251; 333/235

[58] Field of Search ..... 333/208, 209, 210, 211, 333/212, 239, 248, 33–35, 251, 202, 219, 231–232, 235

[56] References Cited

U.S. PATENT DOCUMENTS

| | | | |
|---|---|---|---|
| 2,697,209 | 12/1954 | Sichak et al. | 333/209 |
| 3,212,034 | 10/1965 | Kaufman et al. | 333/209 |
| 3,621,483 | 11/1971 | Craven | 333/210 |
| 3,758,879 | 9/1973 | Beguin et al. | 333/111 |
| 3,940,721 | 2/1976 | Kojima et al. | 333/233 |
| 4,135,133 | 1/1979 | Mok | 333/212 X |
| 4,320,367 | 3/1982 | Boujet | 333/209 |

OTHER PUBLICATIONS

Article entitled "Theory & Design of Low-Insertion Loss Fin-Line Filters" by Arndt et al., published at pp. 155–163 of IEEE Transactions on Microwave Theory and Techniques, Feb. 1982.

Article entitled "A New Class of Optimized Fin-Line & E-Plane Metal Insert Filters with Improved Characteristics" by Vahldieck et al., published at pp. 182–184 of the 1985 IEEE MTT-S Digest.

Article entitled "Design of Waveguide E-Plane Filters with All-Metal Inserts" by Shih, published at pp. 695–704 of IEEE Transactions on Microwave Theory and Techniques, Jul. 1984.

The characteristics of various obstacles in waveguides are described in Chapter 9, pp. 142–157 of "Microwave Transmission Design Data", by Moreno, republished 1958 by Dover.

*Primary Examiner*—Marvin L. Nussbaum

*Attorney, Agent, or Firm*—Henry I. Steckler; Paul R. Webb, II; James C. Davis, Jr.

[57] ABSTRACT

A waveguide bandpass filter includes a fenestrated conductive septum which may be printed on a dielectric circuit board. The center frequency is tuned by a dielectric plate parallel with the septum and contiguous with the fenestrations which is movable in a direction orthogonal to the septum.

20 Claims, 10 Drawing Sheets

TUNABLE WAVEGUIDE BANDPASS FILTER

This invention relates to waveguide bandpass filters for microwave or millimeter wave use which include one or more conductive septa which define one or more fenestrations or windows. Tuning of the center frequency of the bandpass characteristic is accomplished by a dielectric strip or plate which is movable towards or away from the fenestration or fenestrations.

BACKGROUND OF THE INVENTION

Bandpass filters are widely used in communications systems for frequency division multiplexing, to reduce extraneous noise, for impedance matching and the like. At microwave frequencies (roughly 3 to 30 GHz) and at millimeter-wave frequencies (roughly 30 to 300 GHz), electrical signals are often transported by transmission lines in the form of waveguides, which are elongated metal tubes, often having a rectangular or circular cross section. The signals propagate within the tube defined by the conductive walls. Waveguide filters may be implemented with a variety of structures, including conductive diaphragms partially closing off the waveguide with symmetrical or asymmetrical windows, metallic posts and rings. At microwave and millimeter-wave frequencies, these structures may be difficult to fabricate with the accuracy required to achieve the desired frequency response. An article entitled "The Design Of A Bandpass Filter With Inductive Strip-Planar Circuit Mounted In Waveguide" by Konishi, attempts to reduce the fabrication problems with a structure consisting of a metal sheet with appropriate patterns that is inserted into the middle of a waveguide parallel to the E plane. As described therein, the metal sheet includes a plurality of fenestrations or windows which have vertical dimensions equal to the full height of the waveguide. An article entitled "Theory And Design Of Low-Insertion Loss Fin-Line Filters" by Arndt et al., published in IEEE Transactions on Microwave Theory and Techniques, Vol. MTT-30, No. 2, February 1982, describes a filter in a waveguide-like structure which includes a dielectric substrate onto which metal strips or posts are bonded which define windows. Methods are given for calculation of the frequency response. When such filters are fabricated, unavoidable tolerances and approximations involved in the calculations result in filters having characteristics which are not at the desired frequency. Furthermore, it may be desirable for test purposes to have the ability to select the bandpass frequency for such purposes as a frequency scanning receiver.

SUMMARY OF THE INVENTION

A waveguide bandpass filter includes a conductive fenestrated septum which may be printed onto a dielectric circuit board. The center frequency is tuned by a dielectric plate oriented parallel with the septum and contiguous with the fenestrations. The dielectric plate is movable in a direction orthogonal to the septum.

Figure 12A:
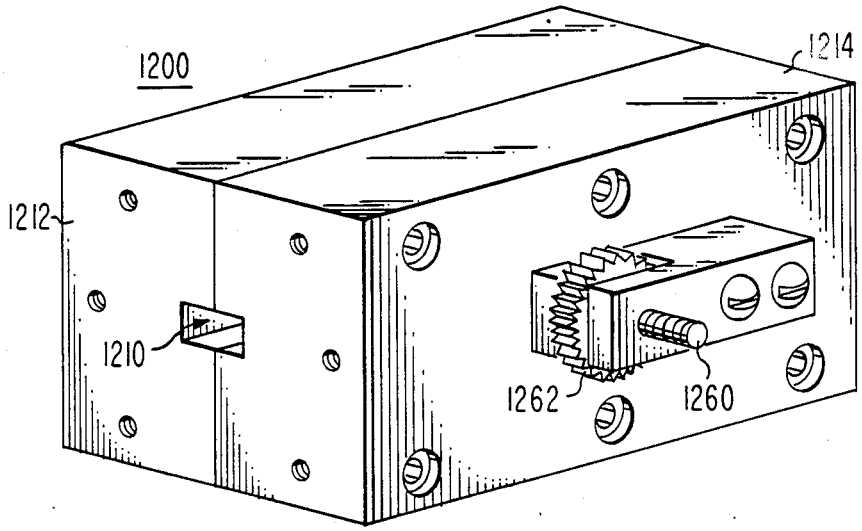
Figure 12B:
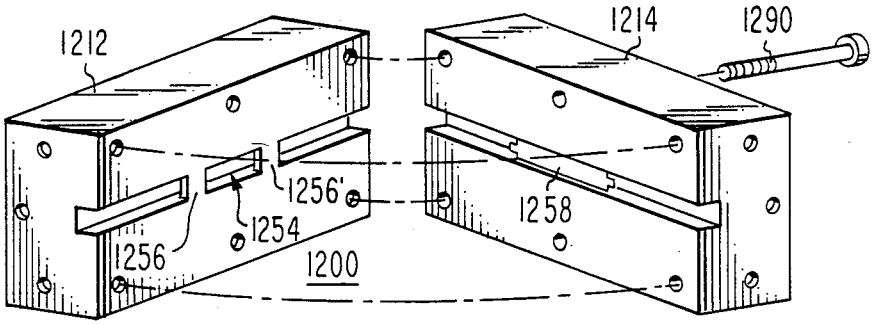
Figure 12C:
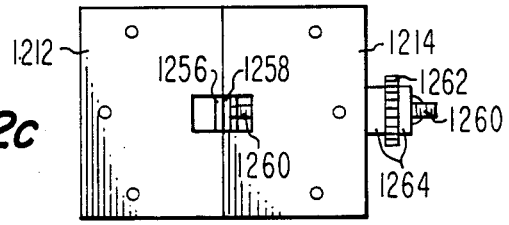

FIG. *7a* is an isometric view of yet another embodiment of the invention, and FIG. *7b* is a cross section of the structure of FIG. *7a* looking the direction of lines 7B—7B;

FIGS. 8, 9, 10 and 11 illustrate various shapes which the dielectric plate used in the arrangements of FIGS. 2, 4, 5, 6 and *7a* may take for impedance matching purposes;

FIG. 12*a* is an isometric view of an assembled waveguide filter according to an embodiment of the invention, FIG. 12*b* is an exploded view of two halves of the assembly of FIG. 12*a*, and FIG. 12*c* is a view along the axis of the waveguide of the structure of FIG. 12*a;*

Figure 13A:
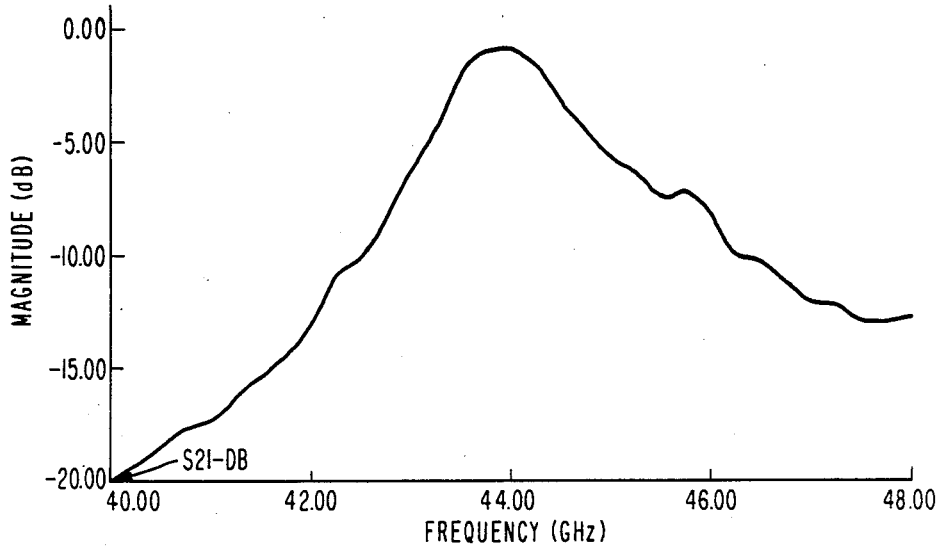
Figure 13B:
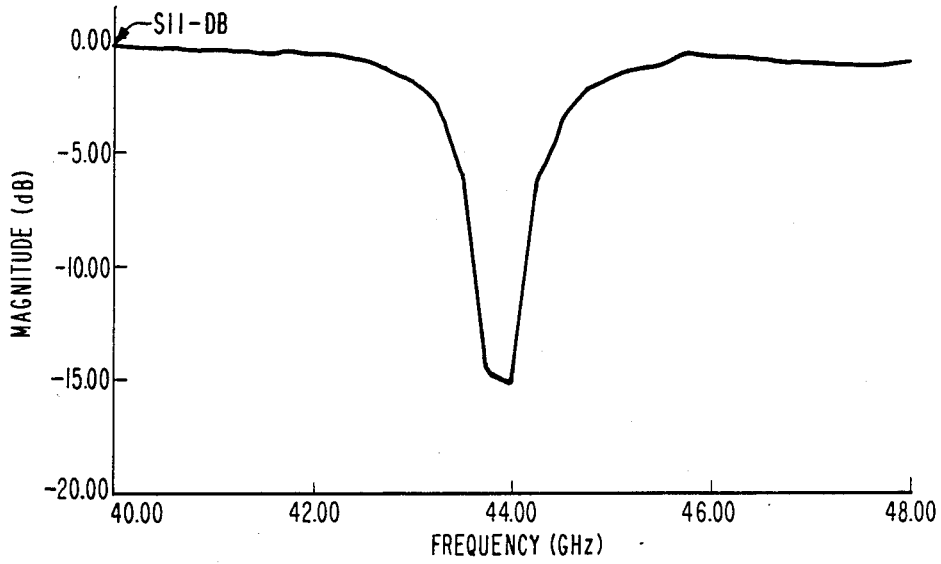
Figure 14A:
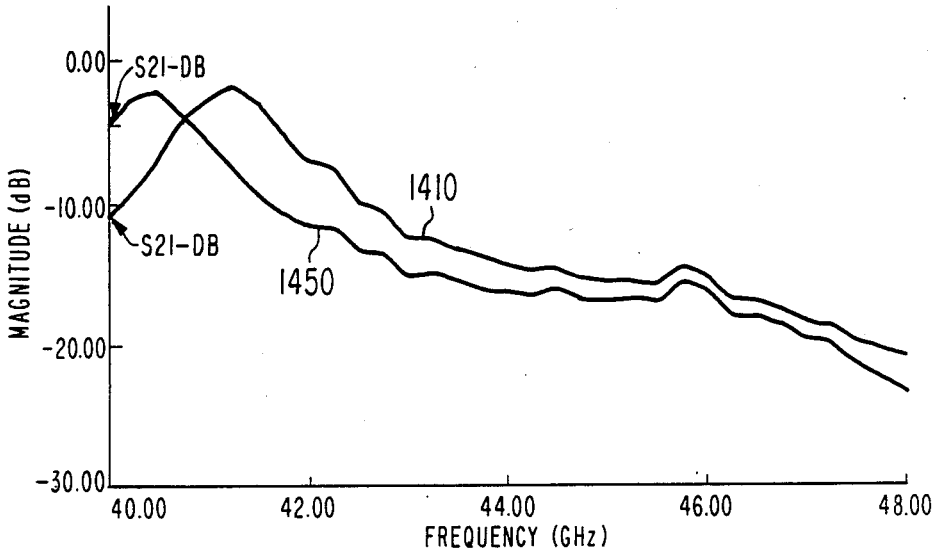
Figure 14B:
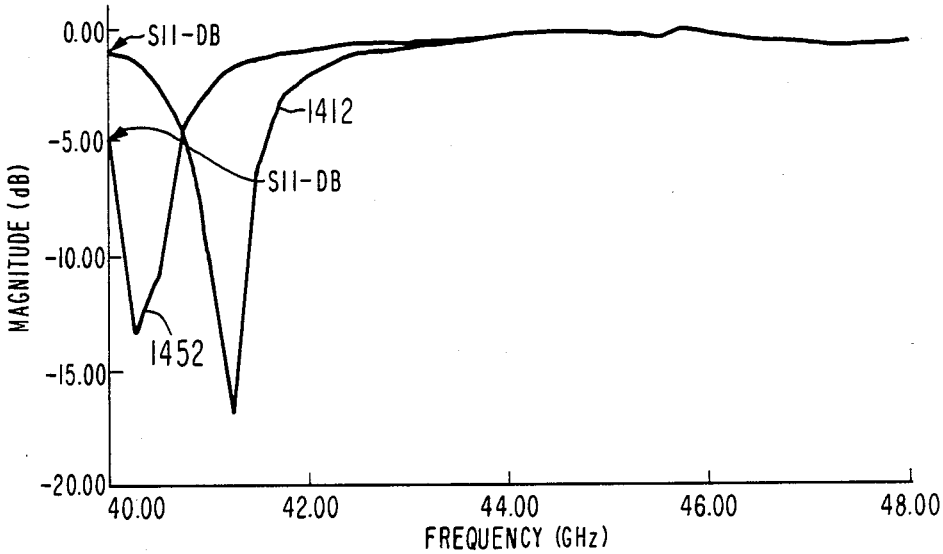
Figure 15A:
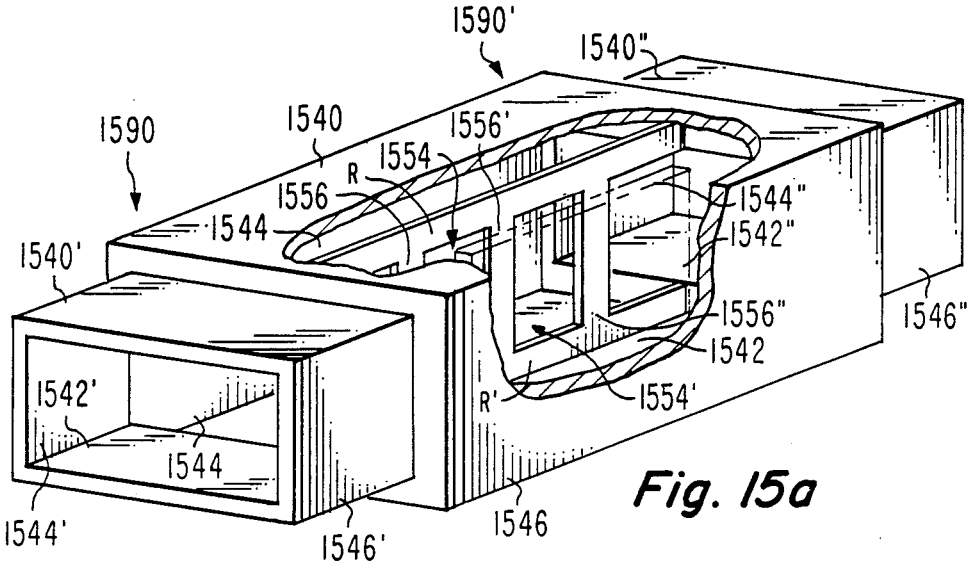
Figure 15B:
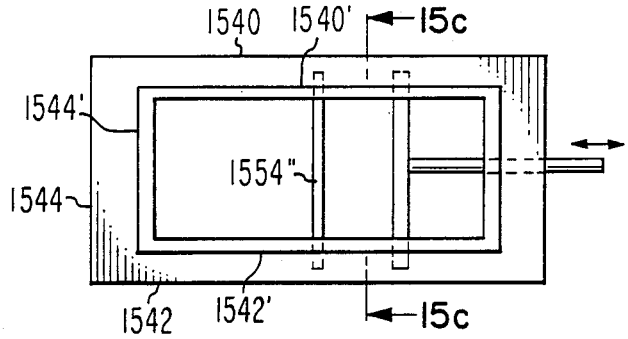
Figure 15C:
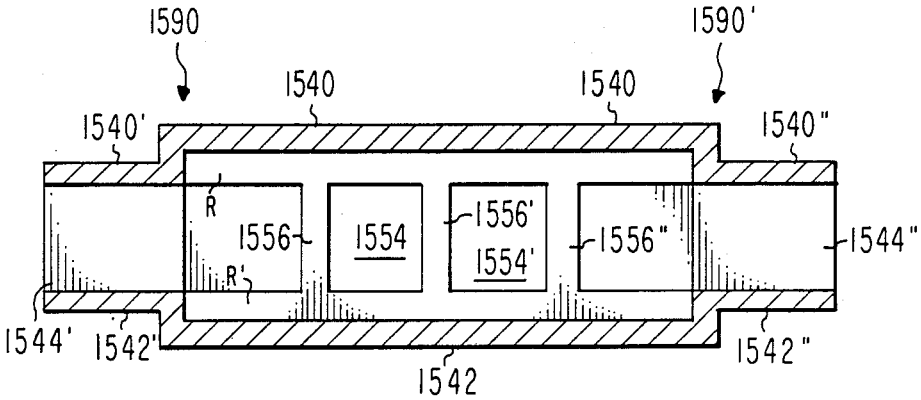

FIG. 13*a* is a plot of transmission or through loss versus frequency for the filter illustrated in FIG. 12*a*, and FIG. 13*b* is a plot of return loss;

FIGS. 14*a* and 14*b* are plots of through loss and return loss of the filter of FIG. 12*a* for various alternative positions of the tuning member;

FIG. 15*a* is an isometric view of a filter, partially cut away to reveal interior details, according to another embodiment of the invention, FIG. 15*b* is an end view thereof, and FIG. 15*c* is a sectional view taken in the direction of arrows 15C—15C of FIG. 15*b;*

Figure 3:
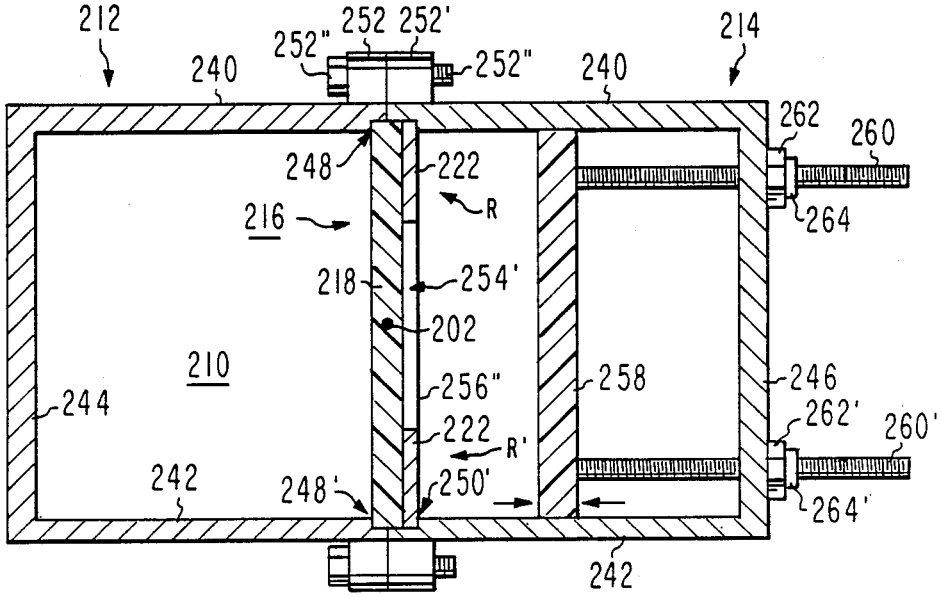
FIG. 3 is a cross section of the structure of FIG. 2 taken along the lines 3—3.
Figure 5:
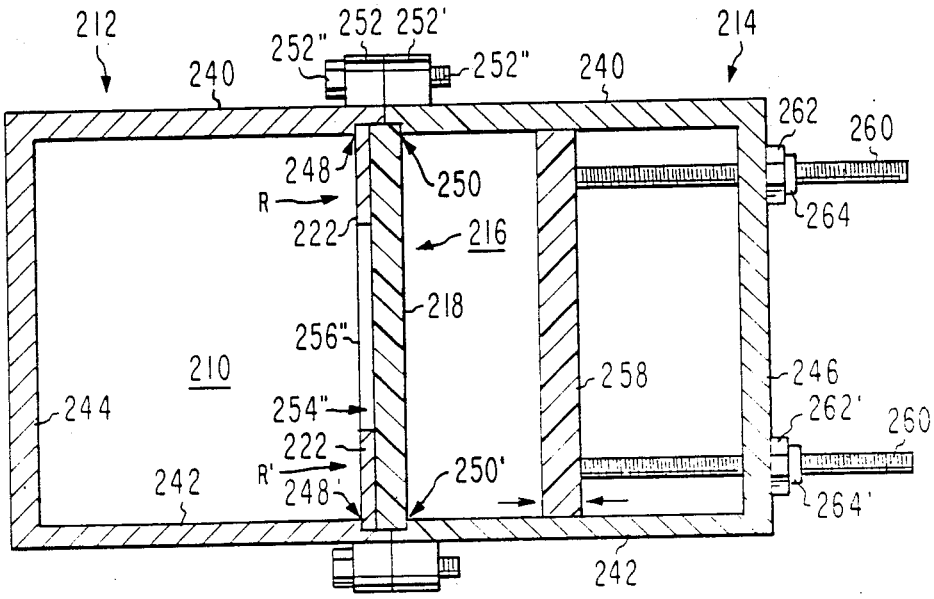
FIGS. 5 and 6 are cross sections equivalent to that of FIG. 4, but of other embodiments of the invention.
Figure 6:
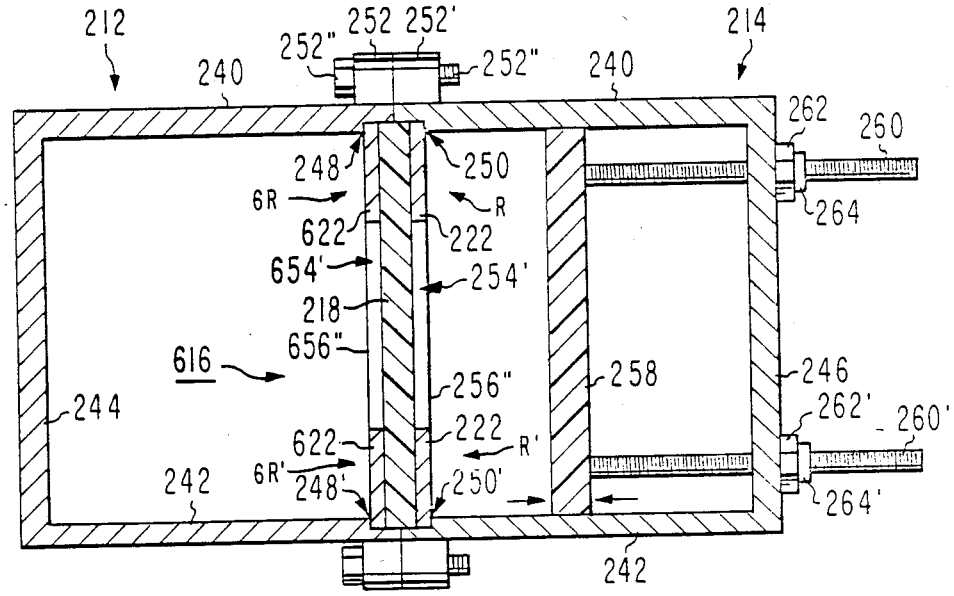
Figure 7A:
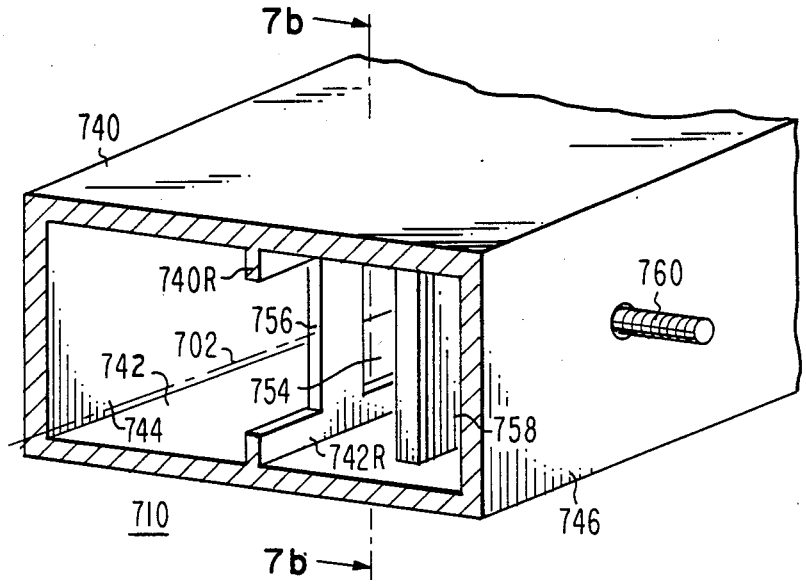
Figure 7B:
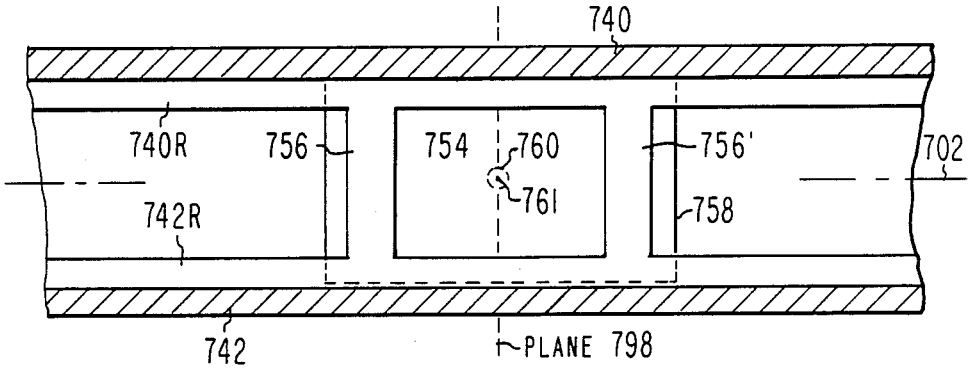
Figure 16:
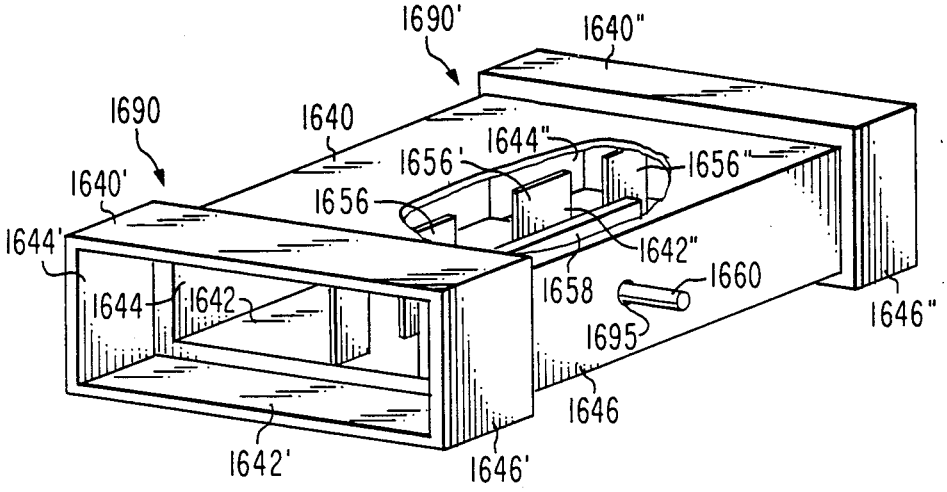
Figure 17:
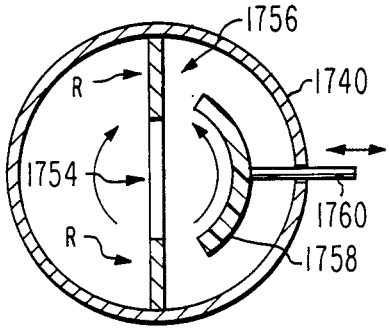
Figure 18:
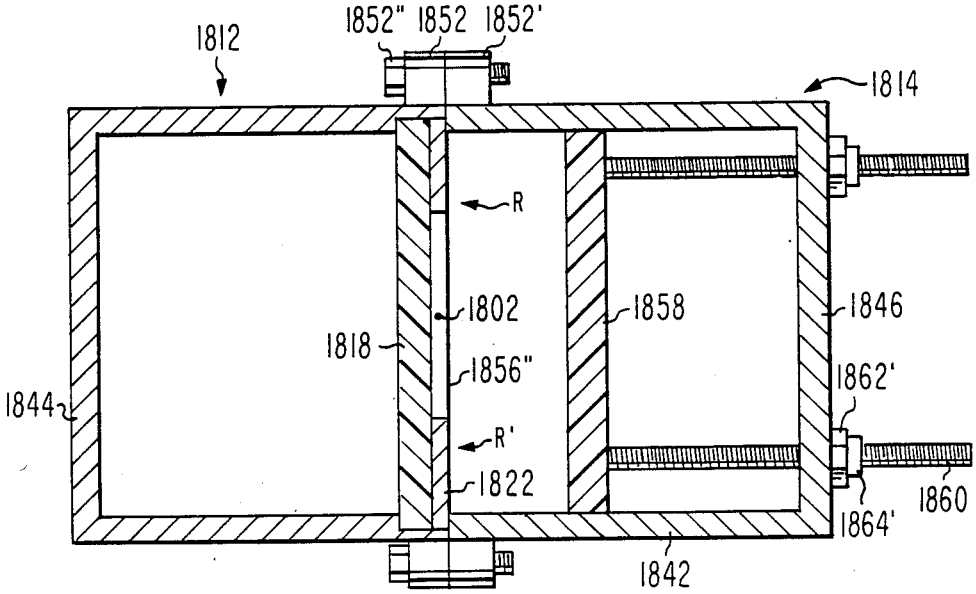

FIG. 16 is an isometric view of a filter, partially cut away, according to another embodiment of the invention;

FIG. 17 a cross section of an embodiment of the invention using circular waveguide; and FIG. 18 is a cross section of an embodiment of the invention similar to the cross sections of FIGS. 3, 5 and 6 in which a single conductive sheet is centered within the waveguide.

DETAILED DESCRIPTION OF THE INVENTION

Figure 1:
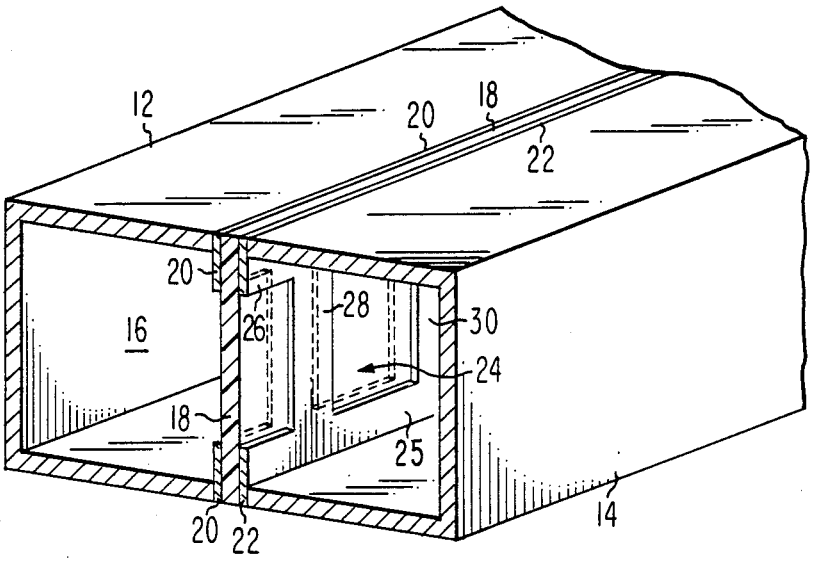
Fig. 1 PRIOR ART
FIG. 1 is an isometric view of a portion of a waveguide bandpass filter according to the prior art, which includes metallic septums (septa) formed on a dielectric plate.

The arrangement of FIG. 1 illustrates the prior art as illustrated in the aforementioned Arndt article. In FIG. 1, two generally U-shaped conductive channels 12 and 14 are positioned with the channels facing each other and would form a closed rectangular waveguide, but for a printed circuit board designated generally as 16 sandwiched therebetween. Printed circuit board 16 is an assembly which includes a dielectric plate 18 onto a first broad side of which is affixed a conductive sheet 20. A second conductive sheet 22 is affixed to the opposite broad side of dielectric plate 18. A pattern of nonconductive regions similar to rectangular fenestrations or windows are formed in conductive sheet 22. A portion of a fenestration 24 formed in conductive sheet 22 is visible in FIG. 1. A similar fenestration is formed in conductive sheet 20 at a location corresponding to that of fenestration 24 and is registered therewith. As illustrated, fenestration 24 has a height which is less than the full interior height of the waveguide-like structure. Consequently, a ridge of conductive material illustrated as 25 extends between the lower edge of fenestration 24 and the adjacent lower wall of U-shaped channel 14. A similar ridge, not visible in FIG. 1, but which is an extension of ridge 26 visible in the foreground, extends between the upper edge of fenestration 24 and the upper conductive wall of U-shaped channel 14. The pattern of conductive sheet 22 includes conductive septums such as 28 and 30 which extend between the upper ridge 26 and lower ridge 25. As described in the aforementioned Arndt et al. article, such a structure defines a bandpass filter.

Even through the FIG. 1 arrangement is not totally enclosed, and there is a longitudinal nonconductive slot between the two conductive U-shaped channels 12 and 14, the structure acts like a waveguide, and no radiation exits through the slot because of the symmetry of the structure, which is reminiscent of a slotted waveguide line often used for VSWR measurements.

Figure 2:
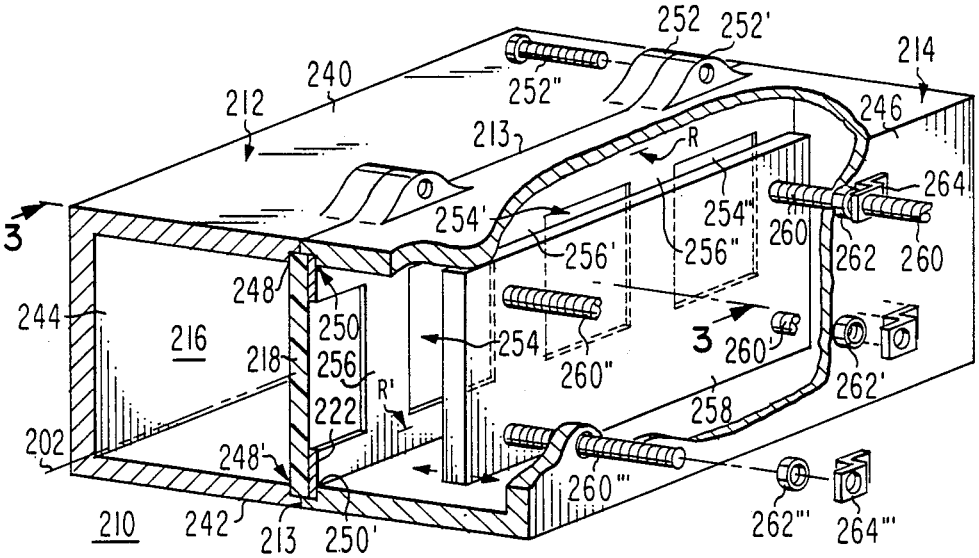
FIG. 2 is an isometric view, partially cut away, of a portion of a waveguide filter according to the invention.

FIG. 2 is a view of a waveguide bandpass filter 210 according to the invention, partially exploded and partially cut away to reveal interior details. In FIG. 2, a portion of two generally U-shaped elongated conductive channels 212 and 214 are joined together along a seam 213 at a plane of symmetry (not illustrated). When so arranged, channels 212 and 214 together define an upper broad conductive wall 240 and a lower broad conductive wall 242 spaced apart by narrow conductive walls 244 and 246. These four walls together enclose an elongated waveguide having a rectangular cross section centered on a longitudinal axis 202. The distance between the interior surfaces of walls 240 and 242 is the height of the waveguide. A printed circuit board designated generally as 216 and including a dielectric plate 218 and a patterned conductive sheet 222 is fitted into slots 248, 248' formed in the edge of channel 240 and into slots 250, 250' formed in the edge of channel 214, and is pressed therebetween when channels 212 and 214 are pressed into contact along seam 213. Channels 212 and 214 are held together by matching sets of lugs affixed to the channels on either side of seam line 213. A representative set of lugs includes a lug 252 affixed to upper wall 240 of channel 212 adjacent seam line 213 and a matching lug 252' affixed to upper wall 240 of channel 214 adjacent lug 252. A screw illustrated as 252" passes through a clearance hole in lug 252 to engage a threaded hole in lug 252' for drawing channels 212 and 214 together. Conductive sheet 222 is in galvanic or conductive contact with upper wall 240 and lower wall 242.

The embodiment of the invention illustrated in isometric view in FIG. 2 and in cross sectional view in FIG. 3 differs from the prior art arrangement illustrated in FIG. 1 in that the printed circuit board (16 of FIG. 1, 216 of FIG. 2) has a conductor pattern only on one side (the near side as viewed in FIG. 2). As in the arrangement of FIG. 1, the pattern of conductor 222 includes one or more fenestrations. In FIG. 2, portions of three fenestrations, 254, 254' and 254" are visible. Another difference, as described below, lies in the presence of a tuning member in the form of a movable dielectric plate 258.

FIG. 3 is a cross section of the structure of FIG. 2 taken along the section lines 3—3. In FIG. 3, elements corresponding to those of FIG. 2 are designated by the same reference numerals. As can be seen in FIGS. 2 and 3, rectangular fenestration 254' has a height which is less than the height of the waveguide as measured between the interior surfaces of broad walls 240 and 242. Consequently, even in the region at which a fenestration occurs, the waveguide includes a pair of elongated upper and lower conductive ridges extending parallel with axis 202 and in contact with the upper (240) and lower (242) conductive walls, respectively. The upper ridge portion of conductive sheet 222 is designated R, and the lower ridge portion is designated R'. Ridge portions R and R' lie in a plane which is close to the plane of symmetry in which seam line 213 lies. The regions between windows define conductive septums which extend from upper ridge R and lower ridge R'. One such septum is clearly visible in FIG. 2, and is designated 256. The septum between fenestration 254 and 254' is designated 256', and the septum lying between fenestration 254' and 254" is designated 256". Septum 256" is visible in the cross section of FIG. 3.

As known, a structure such as that of FIG. 2 as so far described defines a bandpass filter in which the septums (256, 256' . . . ) provide inductive discontinuities spaced apart by predetermined distances, which distances are the widths of the fenestrations. Another viewpoint which can be taken is that each fenestration is a resonator in which the length of the periphery is related to the frequency, and in which each resonator is inductively coupled to the adjacent resonator or resonators by resonator currents flowing in the inductive intervening septum.

Figure 4:
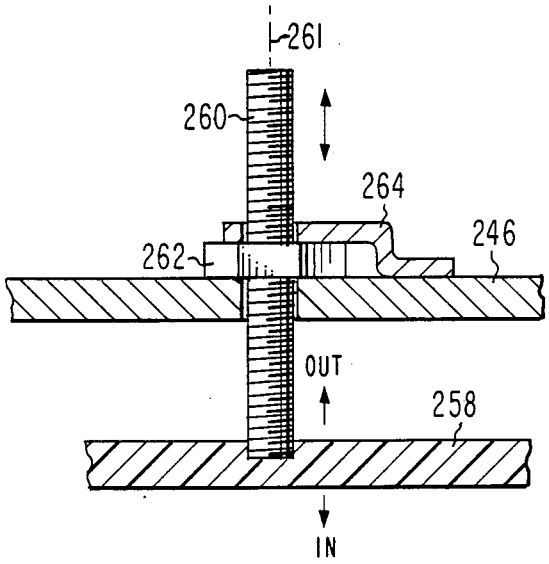
FIG. 4 is a cross sectional view of a captivated screw assembled to the waveguide of FIG. 2.

As mentioned, the resonant frequency and bandpass characteristics of such filters can be calculated, but the calculations are complex, and even when performed carefully may not correctly describe the frequency characteristics of the resonator because of unavoidable mechanical tolerances relating to the construction of the filter. In accordance with the invention, a tuning capability is provided by a dielectric plate 258 oriented parallel to printed circuit board 216, and therefore parallel to the plane of conductive sheet 222. Dielectric plate 258 is located within waveguide 210 and oriented parallel to printed circuit board 216 and to conductive sheet 222 (a plane parallel to one of its broad surfaces is parallel to a plane which is parallel to a broad surface of dielectric plate 218 or conductive sheet 222). The height of dielectric plate 258 is such that it substantially equals the interior height of waveguide 210. Tuning adjustment is provided by a mounting arrangement which allows dielectric plate 258 to move toward and away from (orthogonal to) conductive sheet 222 while remaining parallel therewith. As illustrated in FIGS. 2, 3 and 4, the mounting arrangement includes four threaded studs (260, 260', 260" and 260'") formed from dielectric material which are rigidly attached to dielectric plate 258 near its corners and which extend orthogonally away from the plate and also away from printed circuit broad 216. As illustrated in FIG. 2, studs 260, 260' and 260" are cut away to enhance clarity. Each stud engages a threaded nut (262, 262' . . . ) which is captivated by a bracket (264, 264' . . . ) (most clearly understood from FIG. 4) which, when assembled with a stud passing therethrough, prevents the captivated nut from moving away from adjacent conductive wall 246. When assembled, the arrangement illustrated in FIGS. 2, 3 and 4 allows dielectric plate 258 to be moved towards or away from conductive sheet 222 by rotation of screws 262, 262' . . . This, in turn, affects the frequency.

FIG. 4 is a cross section of the arrangement of FIG. 2 near stud 260, illustrating the method of captivation of nut 262. Nut 262 is threaded and engages stud 260. Stud 260 cannot rotate about its own longitudinal axis 261 because it is adhesively fastened to dielectric plate 258. Nut 262 is prevented from moving in the direction designated "In" by narrow conductive wall 246, and is prevented from moving in the direction designated "Out" by a bracket 264 which is fastened to wall 246. Nut 262 is free to rotate about axis 261 and in so doing propels stud 260 and the attached dielectric plate 258 in the In or Out direction.

FIG. 5 is a cross section generally similar to that of FIG. 3 of a slightly different embodiment of the invention. In FIG. 5, elements corresponding to those of FIG. 3 are designated by the same reference numerals. The only difference between the arrangement of FIG. 5 and that illustrated in FIGS. 2, 3 and 4 is that conductive sheet 222 of printed circuit board 216 is located on the side of dielectric plate 218 remote from dielectric 258, rather than on the same side. In general, the arrangement of FIG. 5 will have somewhat less tuning range than the arrangement of FIGS. 2–4, because dielectric plate 258 cannot approach the fenestrations, such as fenestration 254'', as closely as in the arrangements of FIGS. 2–4.

FIG. 6 is a cross section corresponding to FIGS. 3 and 5 of an embodiment of the invention which differs from the arrangements of FIGS. 2–4 and FIG. 5 in that the printed circuit board has conductive sheets on both sides of dielectric plate. In this regard, the arrangement of FIG. 6 is more like the prior art arrangement of FIG. 1. In FIG. 6, elements corresponding to those of FIGS. 2–4 are designated by the same reference numeral. In FIG. 6, printed circuit board 616 includes dielectric plate 218 bonded on one broad side to conductive sheet 222. Sheet 222 defines fenestrations, including fenestration 254', and also defines septa including septum 256''. In addition, printed circuit board 616 includes a further conductive sheet 622 on the opposite broad side of dielectric plate 218 which has a pattern identical with that of sheet 222 and which is registered therewith. Consequently, conductive sheet 622 defines fenestrations including a fenestration 654' identical in shape with and registered with fenestration 254', and further defines a conductive septum 656'' extending between an upper ridge 6R and a lower ridge 6R', adjacent to and in registry with ridges R and R' on the right side of dielectric plate 218 as seen in FIG. 6. The arrangement of FIG. 6 with a double conductor pattern has the effect of increasing the bandwidth of the waveguide, but reduces the tuning range available by motion of tuning dielectric plate 258, because the total electric field is shared by conductive sheets 222 and 622, and therefore plate 258 can affect less of the total fields.

FIG. *7a* is an isometric view of another embodiment of the invention, and FIG. *7b* is a cross section along the lines 7B—7B. The arrangement of FIGS. *7a* and *7b* includes a rectangular waveguide designated generally as 710 having a conductive upper and lower broad walls 740 and 742 spaced a part by narrow conductive walls 744 and 746. Waveguide 710 is a ridged waveguide including an upper ridge 740R continuous with upper walls 740 and a lower ridge 742R continuous with lower wall 742, both centered on a plane of symmetry (not designated), passing through the centers of broad walls 740, 742 and central axis 702. Two or more conductive septa extend between upper ridge 740R and lower ridge 742R at spaced locations to define at least one fenestration to form a bandpass filter. Only septum 756 is visible in FIG. *7a*, and only a portion of fenestration 754 is visible. A dielectric plate 758 is located within waveguide 710 and is oriented parallel with the structure including ridges 740R and 742R, and septa 756 and 756'. Plate 758 is movable towards and away from fenestration 754 to effect tuning as described previously. As illustrated in FIG. *7b*, dielectric plate 758 is longer than fenestration 754 and its center 761 lies in a plane 798 which is orthogonal to central axis 702.

In order to reduce reflections attributable to the presence of dielectric plates used for tuning in the embodiments of the invention as so far described, those edges of the dielectric plate facing the upstream and downstream directions (the direction from which energy arrives and the direction in which it leaves) within the waveguide may be tapered or may make a step transition. For definiteness, the dielectric plate tuning elements illustrated in FIGS. 8–11 may be considered alternate embodiments of dielectric plate 258 of FIGS. 2 and 3.

Figure 8:
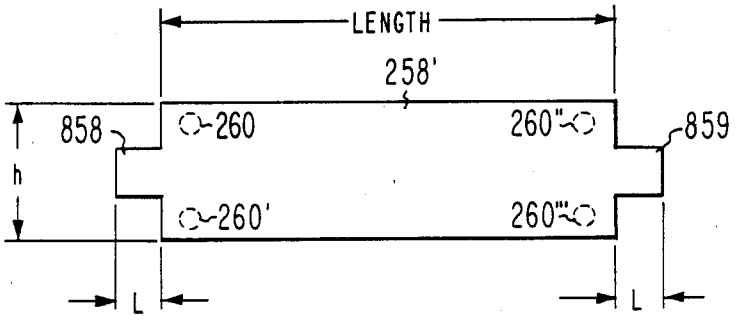

In FIG. 8, dielectric plate 258' has a generally rectangular shape in which height dimension h equals the interior height of waveguide 210 and a length dimension sufficient to subtend or extend across the fenestrations to be tuned. An additional portion of dielectric material in the form of tabs 858 and 859 is added or formed at the ends of dielectric plate 258', each tab having a height which is roughly $\frac{1}{3}$ of dimension h. If tabs 858 and 859 each have a length L of approximately $\frac{1}{4}$ wavelength in the waveguide, the reflections tend to cancel and impedance match is improved.

Figure 9:
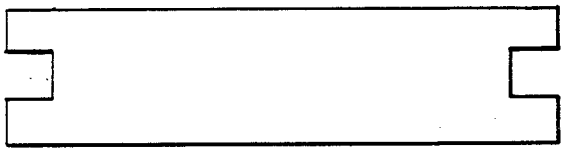
Figure 10:
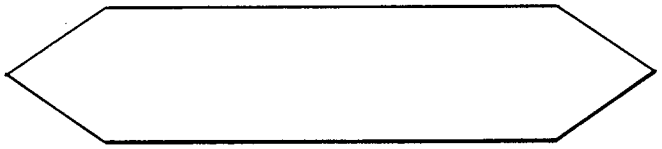
Figure 11:
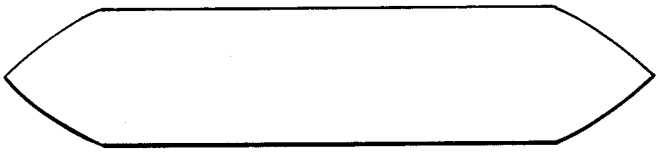

Another step transition arrangement is illustrated in FIG. 9, and FIGS. 10 and 11 illustrate straight and curved tapered transitions.

FIG. *12a* illustrates an assembled view of a millimeter-wave bandpass filter 1200 in accordance with the invention, FIG. *12b* illustrates the bandpass filter of FIG. *12a* in exploded form, and FIG. *12c* illustrates the filter of FIGS. *12a* and *12b* viewed along the axis of the waveguide.

Filter 1200 includes mating conductive blocks 1212 and 1214 which are milled so that when mated they define an elongated rectangular waveguide 1210. The mated halves are held together by screws, one of which is illustrated as 1290 in FIG. *12b*. A pair of thin conductive septa 1256 and 1256' extend across the narrow dimension of the rectangular waveguide in block 1212 and are spaced apart to define a fenestration 1254. A tuning arrangement is associated with block 1214. The tuning arrangement includes a dielectric plate 1258 adhesively fastened to a brass screw 1260 threaded through a serrated nut 1262 captivated by a bracket 1254. As with the arrangement of FIGS. 2, 3 and 4, the tuning arrangement illustrated in FIGS. *12a, b* and *c* allows dielectric plate 1258 to move orthogonal to septa 1256 and 1256' when serrated nut 1262 is rotated. In a particular embodiment of the invention, the waveguide has interior dimensions of 0.112 inches (2.84 mm) high and 0.224 inches (5.69 mm) wide. The conductive septa each have a thickness of 0.005 inches (0.127 mm) and strip width in the direction of propagation of signal of 0.007 inches (1.96 mm). The aperture size defined by the spacing between septa is 0.110 inches (2.79 mm). The dielectric sheet 1258 has an overall length of 0.265 inches (6.73 mm) and a thickness of 0.005 inches (0.127 mm).

FIG. *13a* illustrates the transmission characteristics of filter 1200. The maximum transmission occurs at approximately 44 GHz, and the through loss is approximately 1 dB. FIG. *13b* illustrates the return loss for the same tuning condition as that of FIG. *13a*. As illustrated, maximum return loss (representing best impedance match) is approximately 15 dB at 44 GHz.

FIG. 14*a* illustrates through loss for other positions of dielectric tuning plate 1258 as adjusted by serrated nut 1262. Plot 1410 is a plot of through loss showing maximum transmission at about 41.5 GHz, whereas plot 1450 illustrates a maximum transmission at about 40.5 GHz under a different tuning condition. FIG. 14*b* illustrates as plot 1412 the return loss of the waveguide filter with the tuning which gave transmission plot 1410, and also illustrates as plot 1452 the return loss associated with the tuning of the filter which gave the through loss of plot 1450.

FIG. 15*a* illustrates in cut away isometric view a bandpass filter including step transitions in the waveguide dimensions for reducing higher order mode interaction between resonators to improve the stop-band attenuation and to reduce spurious pass-band response. In the arrangement illustrated in FIG. 15*a*, and illustrated in end view in FIG. 15*b* and in cross section in FIG. 15*c*, the bandpass filter characteristic is desired at a frequency which is near the lower end of the passband characteristic of the smaller waveguide, which is defined by conductive broad walls 1540' and 1542' spaced apart by narrow conductive walls 1544' and 1546'. In accordance with an aspect of the invention, a step transition is made at a location 1590 to a larger size waveguide defined by broad walls 1540 and 1542 spaced apart by narrow walls 1544 and 1546. A conductive septum within the larger waveguide section defines upper and lower ridges R and R' respectively, and conductive interconnections 1556, 1556' and 1556". The upper and lower ridges R, R' together with interconnections 1556, 1556' and 1556" define a pair of fenestrations 1554, 1554'. A further step transition is made at a location 1590' from a larger dimension back to smaller dimensions waveguide defined by walls 1540", 1542", 1544"and 1546".

In a similar fashion, if a bandpass filter characteristic is desired at a frequency near the upper edge of the bandpass characteristic of the waveguide, the filter may be formed within an undersized portion of waveguide, as illustrated in the cut away view of FIG. 16. In the arrangement of FIG. 16, a step transition occurs at locations 1690 between a waveguide defined by broad walls 1640', 1642' and narrow walls 1644' and 1646' and an undersize portion defined by broad walls 1640, 1642 and narrow walls 1644 and 1646. The undersize portion of waveguide also includes spaced-apart conductive septa such as 1656, 1656' and 1656", which coact to define a bandpass characteristic. Also within the undersize waveguide portion is a dielectric tuning plate 1658 which is attached to a plunger 1660 extending through an aperture 1695 in narrow wall 1646 to provide for motion of dielectric plate 1658. A further step transition occurs at a location 1690' from the undersize waveguide back to a larger waveguide defined by broad walls 1640", 1642" and narrow walls 1644", 1646".

While the waveguides as so far described have been rectangular, other waveguide shapes can be used. FIG. 17 illustrates a circular waveguide including a tubular outer wall 1740. A conductive septum 1756 includes ridge portions R and R' and apertures, one of which is designated 1754. A dielectric plate 1758 is curved to conform to the general curvature of the electric fields in the circular waveguide, although this is not absolutely necessary. A shaft or actuating rod 1760 affixed to dielectric element 1758 allows movement of the dielectric plate in a direction orthogonal to that of septum 1756 for tuning the filter.

FIG. 18 illustrates a cross-sectional view similar to that of FIGS. 3 and 5, in which a conductive sheet 1822 bonded to a broad surface of a dielectric plate 1818 defines ridges R, R', conductive interconnections, one of which is illustrated as 1856", and fenestration (not designated), and in which conductive sheet 1822 is centered on longitudinal axis 1802 midway between the inner surfaces of conductive narrow walls 1844 and 1846.

What is claimed is:

1. A bandpass filter, comprising:

first and second elongated mutually parallel conductive broad walls equidistant from and parallel to an axis and spaced apart by a pair of elongated mutually parallel conductive narrow walls to define a hollow rectangular waveguide centered on said axis and having a predetermined length;

an elongated first dielectric plate including mutually parallel first and second broad sides, said plate being oriented with said first and second broad sides parallel with said conductive narrow walls and substantially centered therebetween;

a conductive sheet defining first, second, third and fourth sheet edges, said conductive sheet being bonded to one of said first and second broad sides of said first dielectric plate, said conductive sheet being shorter in the direction of said axis than said predetermined length, said first and second edges of said conductive sheet being in conductive communication with said first and second broad walls, respectively, said conductive sheet defining at least one aperture symmetrically oriented relative to a plane of symmetry equidistant from said first and second broad sides and which passes through said axis, whereby a bandpass filter characteristic is established within a range of frequencies;

a substantially flat second dielectric plate located within said rectangular waveguide, and oriented parallel with said first dielectric plate and located between one of said first and second broad sides and the adjacent one of said conductive narrow walls near said at least one aperture for affecting said range of frequencies; and mechanical adjustment means connected to at least one of said broad walls and said narrow walls and to said second dielectric plate for selectively moving said second dielectric plate towards or away from said first dielectric plate.

2. A filter according to claim 1 wherein said conductive sheet is bonded to said first broad side of said first dielectric plate, and said second dielectric plate is located between said second broad side of said first dielectric plate and the adjacent conductive narrow wall.

3. A filter according to claim 1 wherein said conductive sheet is bonded to said first broad side of said first dielectric plate, and said second dielectric plate is located between said conductive sheet and the adjacent conductive narrow wall.

4. A waveguide filter, comprising:

waveguide means including an input port adapted to be coupled to a source of signals to be filtered and also including an output port adapted to be coupled to utilization means, said waveguide means including conductive first and second broad walls spaced apart by conductive first and second narrow walls, thereby defining a rectangular waveguide having cross-sectional dimensions;

a flat elongated rectangular conductive septum including first and second long edges, first and second short edges, and mutually parallel broad sides, said septum being oriented within said rectangular waveguide means with said broad sides parallel to and substantially equidistant from said first and second narrow walls, and with said first and second long edges in electrical contact with said first and second broad walls, respectively, with said first short edge facing in the direction of said first port for splitting said signals to be filtered into first and second portions propagating in the regions between said first narrow wall and said septum, and second narrow wall and said septum, respectively, said septum further defining at least one aperture symmetrically located between said first and second broad walls, whereby said first and second portions of said signals propagate past said aperture and recombine in the region between said second short edge of said septum and said output port to form an output signal filtered in a frequency range; and dielectric tuning means located to least between said first narrow wall and said septum for differentially affecting said first and second portions of said signal to be filtered for causing an interaction between said first and second portions at said aperture whereby said frequency range is affected.

5. A filter according to claim 4 wherein said septum defines a plurality of spaced-apart apertures, each of which is symmetrically disposed relative to said first and second broad walls.

6. A filter according to claim 4 further comprising a dielectric plate attached to one of said broad sides of said conductive septum.

7. A filter according to claim 6 wherein said dielectric plate is attached to that broad side of said septum which is facing said first narrow wall.

8. A filter according to claim 6 wherein said dielectric plate is attached to that broad side of said septum which is facing said second narrow wall.

9. A filter according to claim 4, wherein said input and output ports each have dimensions which are one of larger and smaller than said cross-sectional dimensions of said rectangular waveguide, said waveguide means further comprising first and second rectangular waveguide stepped dimension transitions coupled to said input and output ports and to said first and second broad walls and to said first and second narrow walls.

10. A waveguide bandpass filter, comprising:

elongated conductive walls enclosing an elongated waveguide having a longitudinal axis and substantially constant interior cross-sectional dimensions along its length, and in which electromagnetic energy can propagate, said conductive walls being symmetrically disposed about at least one plane of symmetry;

an elongated flat conductive first septum including first and second elongated edges, first and second ends, and first and second mutually parallel broad sides, said first septum extending across said waveguide, perpendicular to said longitudinal axis, each end of said first septum being in contact with said conductive walls, said first septum being located so that said one plane of symmetry is parallel with said first and second broad sides of said first septum and lies within said first septum, said first septum further being located at a predetermined first location along said elongated waveguide, the distance between said first and second elongated edges being much less than the length of said elongated conductive walls;

an elongated flat conductive second septum including first and second elongated edges, first and second ends, and first and second mutually parallel broad sides, said second septum extending across said waveguide, perpendicular to said longitudinal axis, each end of said second septum being in contact with said conductive walls, said second septum being located so that said one plane of symmetry is parallel with said first and second broad sides of said second septum and lies within said second septum, said second septum further being located at a predetermined second location along said longitudinal axis of said elongated waveguide, said second location being spaced at a predetermined distance from said first location such that said first and second septa are separate to define an aperture, whereby said first and second septa and said aperture have bandpass characteristics about a frequency for signals flowing through said waveguide; and dielectric means located continguous with said aperture and movable in a direction orthogonal to said one plane of symmetry for controlling said frequency about which said bandpass characteristics occurs.

11. A filter according to claim 10, wherein:

said elongated conductive walls comprise elongated conductive mutually parallel first and second broad walls, each having a central axis extending in the direction of elongation, said first and second broad walls being spaced apart by elongated conductive narrow walls which together give said elongated waveguide a rectangular cross section, said first and second broad walls being located relative to said one plane of symmetry in such a manner that said axes of said first and second broad walls lie within said plane of symmetry; and wherein said dielectric means comprises an elongated dielectric plate located within said waveguide between said one plane of symmetry and said first narrow wall and symmetrically disposed relative to a second plane passing orthogonally through said one plane of symmetry along a line lying mid-way between said first and second septa.

12. A filter according to claim 11 further comprising a planar second dielectric plate having first and second broad sides, said first broad side of said second dielectric plate being affixed to one of said first and second broad sides of said first and second septa, and said first and second broad sides of said second dielectric plate being parallel with said one plane of symmetry.

13. A filter according to claim 11 wherein said second dielectric plate is located between said one plane of symmetry and said second narrow wall.

14. A filter according to claim 11 wherein said dielectric means comprises a planar elongated dielectric plate having a longitudinal axis and a length between first and second ends which is greater than said predetermined distance, said longitudinal axis being parallel with said central axes of said first and second broad walls, said dielectric plate having a maximum height over its central portion between said first and second ends which is substantially equal to the height of said waveguide, and a height near its first and second ends which is substantially less than said maximum height.

15. A filter according to claim 14, wherein said dielectric plate includes a gradual taper between said maximum height over said central portion and said height near its first and second ends.

16. A filter according to claim 10, wherein:

said elongated conductive walls comprise elongated conductive mutually parallel first and second broad walls, each having a central axis extending in the direction of elongation, said first and second broad walls being spaced apart by elongated conductive narrow walls which together with said broad walls give said elongated waveguide an overall rectangular cross section, said first and second broad walls being located relative to said one plane of symmetry in such a manner that said axes of said first and second broad walls lie within said plane of symmetry, and said elongated conductive walls further comprise elongated conductive planar first and second ridges each having elongated first and second edges and mutually parallel broad sides, said first and second ridges being located within said waveguide with said broad sides parallel with said plane of symmetry, and with their first and second edges, respectively, in conductive contact with said first and second broad walls, respectively.

17. A filter according to claim 16 wherein said one plane of symmetry passes through said first and second ridges and parallel to said broad sides of said ridges.

18. A filter according to claim 10 further comprising:

tuning actuation means coupled to said dielectric means for moving said dielectric means in a direction orthogonal to said one plane of symmetry.

19. A filter according to claim 18 wherein said first narrow wall defines a through hole, and wherein said tuning actuation means comprises:

at least one screw connected to said dielectric means and extending in a direction orthogonally away from said one plane of symmetry through said through hole; and a nut captivated to said first narrow wall and engaging said screw for, when rotated, causing said screw to travel in said direction orthogonal to said one plane of symmetry for thereby moving said dielectric means.

20. A filter according to claim 19 wherein said dielectric means comprises an elongated dielectric plate having a length in the direction of elongation greater than said predetermined distance, the center of said dielectric plate lying in a second plane orthogonal with said one plane of symmetry and located mid-way between said first and second septa.

* * * * *